United States Patent [19]

Adkins

[11] 4,088,385

[45] May 9, 1978

[54] SHIELDED CONNECTORS FOR CLOSELY SPACED TERMINALS

[75] Inventor: Russell M. Adkins, Batesburg, S.C.

[73] Assignee: Westinghouse Air Brake Company, Swissvale, Pa.

[21] Appl. No.: 753,638

[22] Filed: Dec. 23, 1976

[51] Int. Cl.[2] ..... H01R 15/06

[52] U.S. Cl. ..... 339/143 R; 339/177 E

[58] Field of Search ..... 339/143 R, 143 C, 177 E, 339/89 C, 90 C, 91 P

[56] References Cited

U.S. PATENT DOCUMENTS

| | | | |
|---|---|---|---|
| 2,798,113 | 7/1957 | Koller et al. | 339/177 E X |
| 3,869,187 | 3/1975 | Bingham | 339/91 P |

FOREIGN PATENT DOCUMENTS

| | | | |
|---|---|---|---|
| 695,439 | 8/1953 | United Kingdom | 339/177 E |

OTHER PUBLICATIONS

IBM Technical Disclosure Bulletin, "Terminal for Coaxial Cable," Evans & Uberbacher, vol. 9, No. 3, Aug. 1966, p. 252.

IBM Technical Disclosure Bulletin, "Electromagnetic Shielded Connector," Bunch & Kantner, vol. 15, No. 1, Jun. 1972, pp. 34, 35.

*Primary Examiner*—Roy Lake
*Assistant Examiner*—E. F. Desmond
*Attorney, Agent, or Firm*—A. G. Williamson, Jr.; R. W. McIntire, Jr.

[57] ABSTRACT

All insulation is removed from a preselected length of the center conductor at one end of a short piece of coaxial cable. An adjacent portion of the outer jacket is also removed and the corresponding sheath folded back upon itself. A tubular contactor is crimped over the exposed conductor and preformed at the outer end to plug onto a device terminal to complete an electrical circuit connection. An insulating tube is placed over the contactor and extends beyond its outer end to recess the circuit connection. Over this tube is placed a metallic ferrule which is positioned even with the insulating tube at the outer end and extends to overlap the undisturbed portion of the cable jacket. The ferrule is welded to a ground plate associated with the terminal and also soldered to the folded back sheath to complete an electrical shield for the circuit connection formed by the contactor and terminal.

1 Claim, 7 Drawing Figures

SHIELDED CONNECTORS FOR CLOSELY SPACED TERMINALS

BACKGROUND OF THE INVENTION

The invention pertains to shielded connectors for closely spaced terminals. More specifically, the invention pertains to a plug type connector to provide a shielded circuit connection for high frequency signals between a coaxial wire lead and any one of closely spaced terminals on a terminal board.

Frequently, it is necessary to make circuit connections in communication apparatus which carry high frequency currents. Such connections need to be shielded, as are the adjacent lead wires, to avoid inductive interference between circuits or from other external sources. A particular example is radio apparatus where switching between transmit and receive modes is most effectively handled by a relay. Mobile and portable radios require small, light-weight elements including such switching relays. These small or so-called miniature relays are generally sealed in metallic cases with mounting means such that the case becomes part of the apparatus ground plane. Coil and contact terminals are then brought out of the case through insulating beads in a header or terminal board which is part of the case grounding plate or plane. Obviously, these terminals are quite closely spaced, for example, a minimum of 0.1 inch in each direction between terminals is an accepted standard. Since radio frequency circuits pass through the relay contacts, shielded connections must be made to the external contact terminals or are at least desirable. Lead wires to these terminals are normally of the coaxial cable type having a center conductor and a sheath which may be grounded to shield the circuit from external interference. The close spacing of the terminals on the relay header or terminal board thus creates a problem in providing shielded circuit connections between the coaxial cable lead and the relay contact. This problem, of course, is not exclusive to the relay connections but also exists in connecting shielded circuits to other closely spaced terminals, e. g., on printed circuit boards.

Accordingly, an object of my invention is a shielded circuit connector for closely spaced terminals.

Another object of the invention is a circuit connector which provides a shielded connection between a coaxial cable lead and a device terminal.

A further object of the invention is a terminal connector for completing shielded circuits to a plurality of closely spaced terminals on a control device.

Still another object of my invention is a coaxial cable connector for connecting high frequency (HF) circuits to contact terminals on a miniature relay.

Also an object of my invention is a coaxial cable connector arrangement for connecting radio frequency (RF) switching circuits to the contacts of a switching relay having closely spaced contact terminals.

A still further object of the invention are shielded terminal connectors for connecting RF circuits to closely spaced switching terminals utilizing coaxial cable leads, plug type contactors, insulation, and shielding ferrules sized to accommodate the close spacing of a plurality of connections without interference.

Other objects, features, and advantages of my invention will become apparent from the following specification when taken with the accompanying drawings and appended claims.

SUMMARY OF THE INVENTION

In the practice of my invention, a selected short length of coaxial cable of small diameter provides the basic element. All insulation is removed at one end to expose a preselected length of the center conductor. An adjacent, also preselected portion of the cable sheath is also exposed by removal of the outer jacket and the sheath folded back on itself. A contactor element, generally tubular in form but with one end formed or adapted to plug onto, i. e., over, the device terminal, is fitted and then crimped onto the exposed length of the center conductor so that the fitted end extends out from the coaxial cable piece. An insulating tube is then placed over the contactor, positioned against the remaining cable insulation and long enough to extend beyond the plug tip of the contactor which is thus recessed inside. The insulation tube inside diameter is selected to provide a reasonably snug fit over the contactor. Finally, a tube or ferrule of conducting material is fitted over the insulating tube with the outer or terminal ends matching. The ferrule extends rearward to overlap the edge of the undisturbed portion of the coaxial cable jacket. The ferrule has a hole or soldering port positioned to open onto the exposed cable sheath when the ferrule is in place. Through this port, a solder connection is made between the sheath and ferrule which electrically connects the ferrule into the shield and mechanically fixes the various elements in place. When the contactor is pushed over the device terminal, it is advanced until the ferrule is in contact with a grounding portion or plate of the device, shown in one specific illustration as the sealed case of a miniature relay. The ferrule is then welded or soldered to this plate to complete the full electrical shielding of the circuit connection.

BRIEF DESCRIPTION OF THE DRAWINGS

I shall now describe in more specific detail one shielded connector embodying the features and concepts of the invention and then point out the novelty thereof in the appended claims. Reference will be made to the accompanying drawings, in which:

In each of the drawing figures, similar reference characters designate the same or similar parts of the apparatus.

DESCRIPTION OF THE ILLUSTRATED EMBODIMENT

Figure 1:
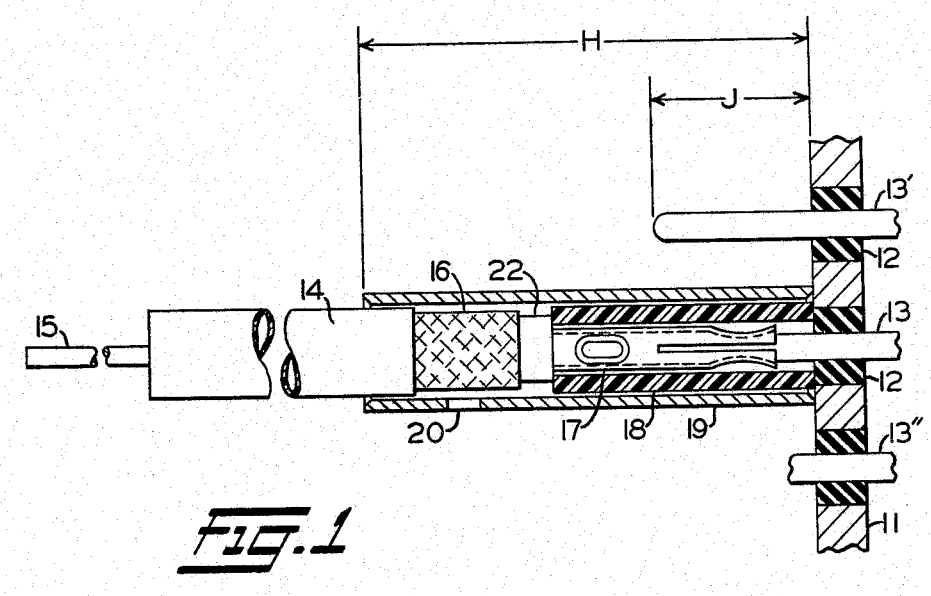
FIG. 1 is a diagrammatic illustration, partly in cross section, of a shielded connector embodying the invention making a shielded connection to one of a plurality of closely spaced terminals on a terminal board of selected apparatus.

Referring to FIG. 1, at the right is shown, in cross section, a terminal board 11, which represents the terminal board on any type of apparatus or printed circuit board. The terminal board or header is specifically shown, to illustrate the invention simply, as a conductive metal plate including insulation sections or beads such as 12 through which pass electrical circuit terminals 13, 13', and 13". The metallic portion of the board or header 11 is considered as a grounding plate or surface. A specific example of such a terminal board arrangement is that used on well known miniature relays sealed in a metal casing 11 with insulating beads 12 through which pass the terminals 13 for the coil and contact circuit connections. These terminals are closely spaced in each direction because of the limited size of the terminal board.

To selected ones of the plurality of terminals, e. g. 13, a fully shielded, coaxial type lead circuit is to be connected, carrying RF currents which require continuous protection from external interference. The terminal connector includes a coaxial lead wire or cable 14 having a center conductor 15. A portion of the cable braid or sheath which provides shielding is shown exposed at 16. The connector further includes a contactor 17, secured to the center conductor and engageable onto the outer end of terminal 13, an insulation tube 18, and a conductive ferrule 19. The specific details of this various elements will now be discussed.

Figure 2:
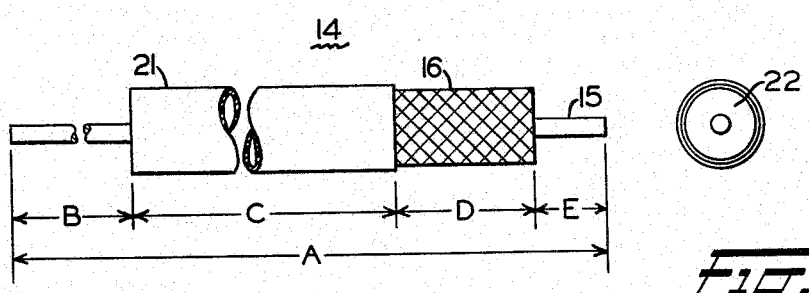
FIG. 2 illustrates the details of a length of coaxial cable when initially prepared for use in the connector of FIG. 1.
Figure 3:
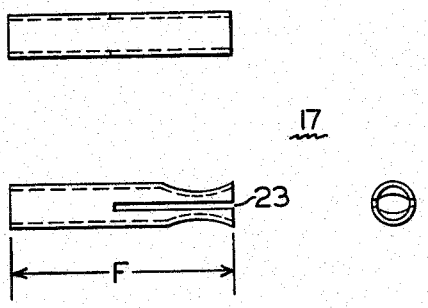
FIG. 3 is a detailed illustration, in conventional three views, of the structure of the central contactor element of the connector of FIG. 1.

Referring to FIG. 2, a piece of coaxial cable 14 is shown with the details of initial preparation for use with the terminal connector. This coaxial lead wire is chosen with a characteristic impedance as required for the system application, one typical value being 50 ohms. The cable length is selected in accordance with the total apparatus requirements, that is, the distance between the terminal 13 and the point at which a circuit connection is made to some other element of the communication apparatus. In other words, the distances A, B, and C are established by other requirements. The outer jacket 21, sheath 16, and insulation 22 are removed from the center conductor 15 at the right end of cable 14 for a preselected distance E. To cross-relate the various measurements, distance E is on the order of approximately one third of the length F of contactor 17 (FIG. 3). The outer jacket is removed from sheath 16 for an additional distance D adjacent to portion E.

Contactor 17 is shown in FIG. 3 with three conventional views to illustrate its detailed structure. It is formed from tubing of conductive material, e. g., hardened copper. A slot 23 is cut from one end for approximately one half the total length F. The slotted end is also shaped, as illustrated, to plug over, i. e., onto, the device terminal 13 to complete a secure and firm electrical connection. The inside diameter (ID) of the tube, which initially remains unchanged at the other end, must be large enough to fit over the coaxial cable center conductor. The outside diameter (OD) is selected to give sufficient wall strength to the contactor to plug easily onto the terminal but should be less than the diameter of the insulation between the coaxial center conductor and the sheath.

Figure 4:
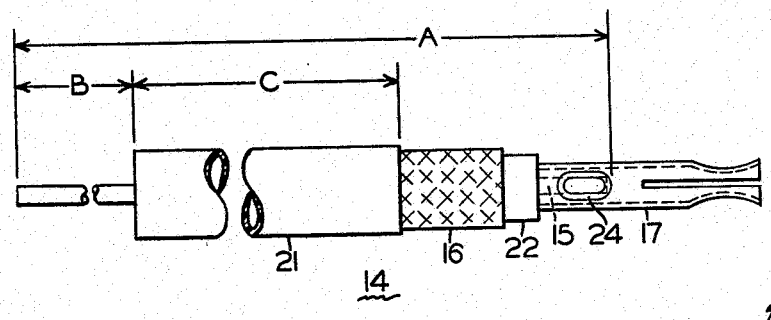
FIG. 4 is a diagrammatic showing of the contactor of FIG. 3 assembled to the cable of FIG. 2.

As shown in FIG. 4, contactor 17 is fitted over conductor 15 of the cable and secured by crimping (designated by the symbol 24) in four places, 90° apart. During this initial assembly, the sheath 16 is also folded back upon itself from the forward edge of insulation 22 to clear contactor 17 and assure no accidental grounding of conductor 15.

Figure 5:
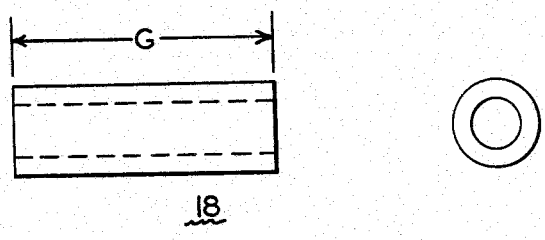
FIG. 5 is a detailed illustration of the insulation tube used in the assembled connector of FIG. 1.

The insulating tube 18 (FIG. 1) is shown in greater detail in FIG. 5. It is a simple tube of insulating material, e. g., hard plastic. The ID must be greater than the OD of the contactor but small enough that the tube butts against the shoulders of insulation 22 (see FIG. 1). The OD of tube 18 is approximately the same as that of the coaxial cable. The length G of the insulation tube is to be greater than the length F of contactor 17 so that the actual plug connection between contactor 17 and terminal 13 is recessed within tube 18 (see FIG. 1).

Figure 6:
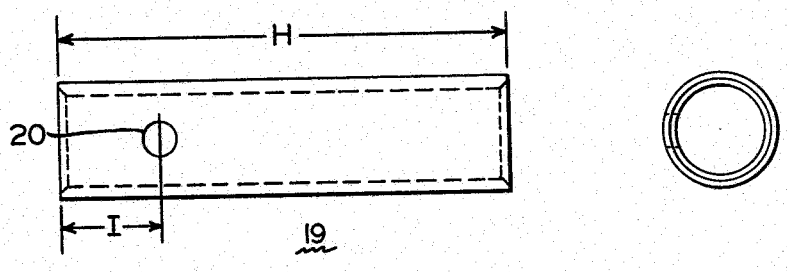
FIG. 6 shows detailed views of the shielding ferrule of the connector.

The details of the outer shield for the terminal connector are shown in FIG. 6. Ferrule 19 is made of conducting material, e. g., a cupro-nickel tubing. The length H of ferrule 19 must be sufficient to reach from the terminal block header to overlap slightly the undisturbed outer jacket of cable 14 (see FIG. 1). In other words, length H is somewhat greater than the sum of lengths G (FIG. 5) and D (FIG. 2). The ID is such as to fit over insulating tube 18 and the cable jacket while the OD is limited to allow space between the shields of connectors to adjacent terminals. Each end of ferrule 19 is chamferred to facilitate a weld or solder connection to the header 11 as will be explained. A hole or soldering port 20 is drilled in ferrule 19 at a distance I from one end. The distance I is selected such that hole 20 appears over the folded back sheath 16 to serve as a soldering port to connect the outer shields.

Referring again to FIG. 1, it is to be noted that, after the initial assembly shown in FIG. 4, the terminal connector is completed by placing tube 18 and ferrule 19 over the contactor 17 and cable assembly, with the header ends of the tube and ferrule even. The connector assembly is then engaged to terminal 13 by plugging contactor 17 over terminal 13. Tube 18 and ferrule 19 limit the movement of the connector when they engage the header or terminal board surface. Ferrule 19 is then soldered or welded to the device grounding plate represented by header 11 although this may be done prior to final assembly of the connector. Ferrule 19 is also secured to sheath 16, both electrically and mechanically, by soldering through hole or port 20. An electrical circuit from conductor 15 through contactor 17 to terminal 13 and a continuous shield from sheath 16 to header plate 11 including ferrule 19 are now complete.

Figure 7:
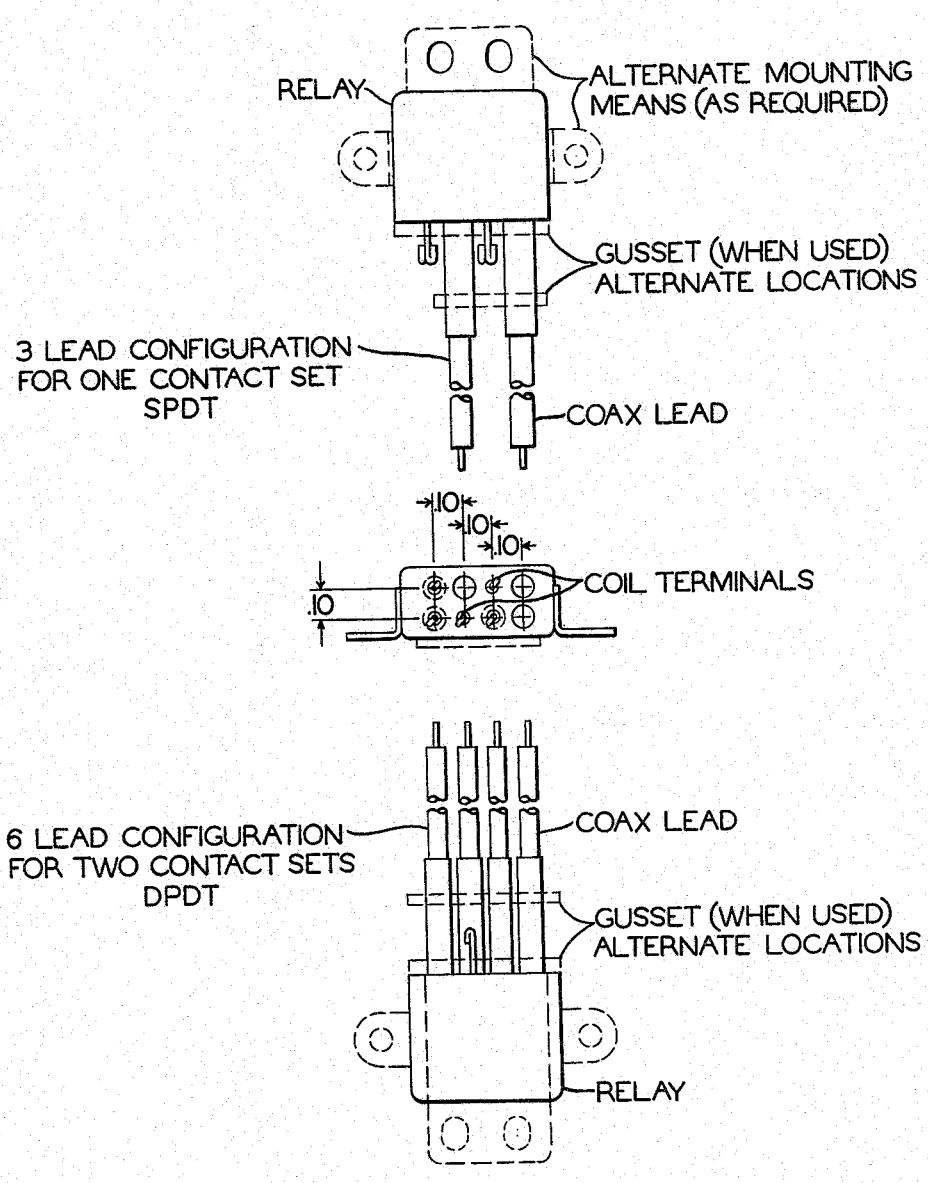
FIG. 7 is a schematic illustration of more than one connector of FIG. 1 used to connect external shielded circuits to contact terminals on a sealed miniature relay.

One specific use for the shielded connectors herein disclosed is illustrated in FIG. 7. Two different examples of miniature relays are shown in schematic representation at the top and bottom with a single typical terminal board configuration in the center view. Only the metallic case or enclosure for the relay, with typical mounting brackets, and the external coil and contact terminals are specifically shown. Each relay has space for eight terminals but all positions may not be used. A specific spacing between adjacent terminals in a row and between rows is designated in the center view, this being an accepted minimum spacing. Such relays, as mentioned, are frequently used in portable or mobile radio apparatus to switch RF circuits between transmit and receive modes. In the upper example, only a single set of contacts (SPDT) are used for RF switching and thus only three terminal connectors are needed. This is the specific arrangement shown in the terminal board view. In the lower example, two sets of contacts are used (DPDT) and six connectors are required, i. e., on all but the two coil terminals. It is to be noted that the OD of the ferrule must be less than 0.1 inch, e. g., 0.096 inch. This allows a 0.004 inch spacing between connectors. For the same example, the length H is approximately 0.375 inch while the complete coaxial cable lead would typically be on the order of 8 inches or less. One method of assembling the connectors on the relay is to weld or solder the necessary ferrules in place on the header plate, spanning the insulation beads through which the terminals emerge. The coaxial cable and contactors 17 are assembled and covered with insulating tubes 18. The contactors are then plugged onto the proper relay terminal to complete the RF circuit connections. Finally, each ferrule is soldered to the corresponding cable sheath to complete the electrical shield around the circuit and to secure the connector in place.

The shielded connector of my invention thus provides an effective and efficient manner of making circuit connections to terminal boards where space limitations are severe. The complete circuit connections are secure and of low resistance and shielding is complete from the incoming coaxial cable lead to the apparatus ground, thus protecting HF circuits from external interference and from cross interference between adjacent connections. Assembly of the terminal connectors is simple and thus economic.

Although I have herein shown and described but one specific shielded terminal connector embodying the concepts of my invention, it is to be understood that various changes and modifications within the scope of the appended claim may be made without departing from the spirit and scope of my invention.

Having thus described my invention, what I claim is:

1. A method of completing a shielded circuit connection from a coaxial cable lead to any one of a plurality of terminals on a device terminal board with an associated grounding plate, including the steps of:

(a) removing all insulation from a selected length of the center conductor at one end of said coaxial cable, (b) removing the outer jacket covering the adjacent portion of the coaxial cable sheath and folding the exposed sheath back on itself, (c) crimping a fitted contactor to the exposed center conductor, (d) fitting an insulation tube over said contactor when secured to said central conductor, (e) welding or soldering to said grounding plate, so as to enclose said one terminal, a conductive ferrule having a diameter to fit over said insulation tube when in place over said contactor and having a length to also cover said exposed sheath and fit onto the cable jacket beyond, (f) completing a circuit connection by inserting the covered contactor and insulation tube inside said ferrule to couple said contactor to said one terminal, and (g) soldering said ferrule to said exposed cable sheath to complete the circuit connection shield between said grounding plate and cable sheath and to hold said contactor and insulation tube in place.

* * * * *